United States Patent [19]

Duckett

[11] Patent Number: 5,006,010

[45] Date of Patent: Apr. 9, 1991

[54] ROADWAY WITH UNI-DIRECTIONAL LIGHT REFLECTIVE LANE MARKER

[76] Inventor: John W. Duckett, 4905 Ranch Rd., Tiburon, Calif. 94920

[21] Appl. No.: 431,573

[22] Filed: Nov. 3, 1989

[51] Int. Cl.[5] ..... E01F 9/06; E01F 9/08

[52] U.S. Cl. ..... 404/12; 404/9

[58] Field of Search ..... 404/1, 6, 7, 9, 12, 404/13, 14, 16, 11, 93, 94; 350/97, 100, 102, 103, 104, 109

[56] References Cited

U.S. PATENT DOCUMENTS

| | | | |
|---|---|---|---|
| 1,956,252 | 4/1934 | Robertson | 350/97 |
| 2,007,524 | 7/1935 | Emmons | 404/9 X |
| 2,345,644 | 4/1944 | Weber | 404/7 |
| 3,319,542 | 5/1967 | Bergsnov-Hansen | 350/104 |
| 3,332,327 | 7/1967 | Heenan | 404/16 |
| 3,396,639 | 8/1968 | Lemelson | 404/14 |
| 3,784,279 | 1/1974 | Hedgewick | 350/103 |
| 3,836,226 | 9/1974 | Cechetini | 350/103 |
| 3,836,275 | 9/1974 | Finch | 404/13 |
| 4,136,990 | 1/1979 | Morgan | 404/9 |
| 4,145,112 | 3/1979 | Crone et al. | 350/103 |
| 4,182,548 | 1/1970 | Searight et al. | 350/103 |
| 4,236,788 | 12/1980 | Wyckoff | 350/97 |
| 4,284,365 | 8/1981 | Rabinow | 404/9 |
| 4,395,155 | 7/1983 | Bartolotti et al. | 404/9 |
| 4,500,225 | 2/1985 | Quittner | 404/6 |

*Primary Examiner*—Ramon S. Britts
*Assistant Examiner*—Gay Ann Spahn
*Attorney, Agent, or Firm*—Phillips, Moore, Lempio & Finley

[57] ABSTRACT

A plurality of uni-directional light reflective lane markers are adapted for securance on a roadway to separate and delineate laterally adjacent traffic lanes from each other. Each lane marker comprises an elongated delineating strip extending longitudinally in a first direction and a plurality of longitudinally spaced light reflectors on the delineating strip for visually displaying the strip when it is viewed in the first direction and for at least substantially rendering the strip invisible when it is viewed in the second direction, opposite to the first direction. Thus, a particular traffic lane is clearly delineated for traffic travelling in the first direction, but is rendered substantially invisible when viewed by traffic travelling in the second, opposite directions. Conversely, the lanes for traffic travelling in the second direction are clearly delineated for oppositely moving traffic. Each lane marker preferably comprises a molded plastic member embedded in flush relationship in the roadway and the light reflectors are defined on exposed leading surfaces, formed on the proximal sides of a plurality of longitudinally spaced segments formed within the member.

19 Claims, 2 Drawing Sheets a
b
c
d
e
f
g
h
D1
D2
R
III
IV
11
17
18
19
20
21
22
23
24
25
26
27
28

ROADWAY WITH UNI-DIRECTIONAL LIGHT REFLECTIVE LANE MARKER

TECHNICAL FIELD

This invention relates generally to a lane marker for roadways and more particularly to a lane marker that is viewable in only one direction of traffic travel.

BACKGROUND ART

Roadway delineators and markers are commonly used to separate and delineate adjacent traffic lanes. A standard lane marker may comprise a plurality of longitudinally spaced reflector elements secured on a roadway to visually display the lane marker to a driver. The reflector elements are usually formed from standard laminated plastic and ceramic materials and include a suitably colored conventional glass bead or cube-corner retro-reflective material for light reflecting purposes.

In certain lane marker applications, it has proven desirable to visually display the lane marker when traffic moves in one direction and to render the lane marker at least substantially invisible when traffic moves in the opposite direction. For example, when moveable lane barrier systems of the type described in applicant's U.S. Pat. Nos. 4,806,044; 4,815,889 and 4,828,425 are mounded on a roadway to separate oppositely directed lanes of traffic, the lane barrier system is moved laterally to increase the number of traffic lanes in one direction to accommodate rush-hour traffic or the like.

In a typical application of this type, a pair of parallel lane markers are formed in the middle of a roadway and separated from each other by approximately two feet to accommodate the width of the lane barrier system. The lane barrier system can thus separate the roadway for normal traffic flow to provide three lanes on each side thereof. When it is desired to move the lane barrier laterally to provide two lanes of traffic in one direction and four lanes of traffic in the opposite direction, each of the parallel pair of intermediate lane markers would be exposed to give rise to driver confusion in respect to delineation of the middle lanes since the pair of lane markers would be visible in both directions of traffic movement.

Further, conventional reflector elements normally project above the roadway to expose them to engagement with the tires of the vehicles. Thus, the drivers are subjected to a "rough ride" when they run over a series of the reflector elements. Furthermore, the reflector elements are subjected to wear and possible damage.

SUMMARY OF THE INVENTION

An object of this invention is to provide an improved and economical uni-directional reflective lane marker adapted for securance on a roadway for separating laterally adjacent traffic lanes from each other.

The lane marker comprises an elongated delineating strip extending longitudinally in a first direction and light reflective means on the delineating strip for visually displaying the strip when it is viewed in such first direction and for at least substantially rendering the strip invisible when it is viewed in a second direction, opposite to the first direction.

BRIEF DESCRIPTION OF THE DRAWINGS

Other objects and advantages of this invention will become apparent from the following description and accompanying drawings wherein.

DESCRIPTION OF THE PREFERRED EMBODIMENT

Figure 1:
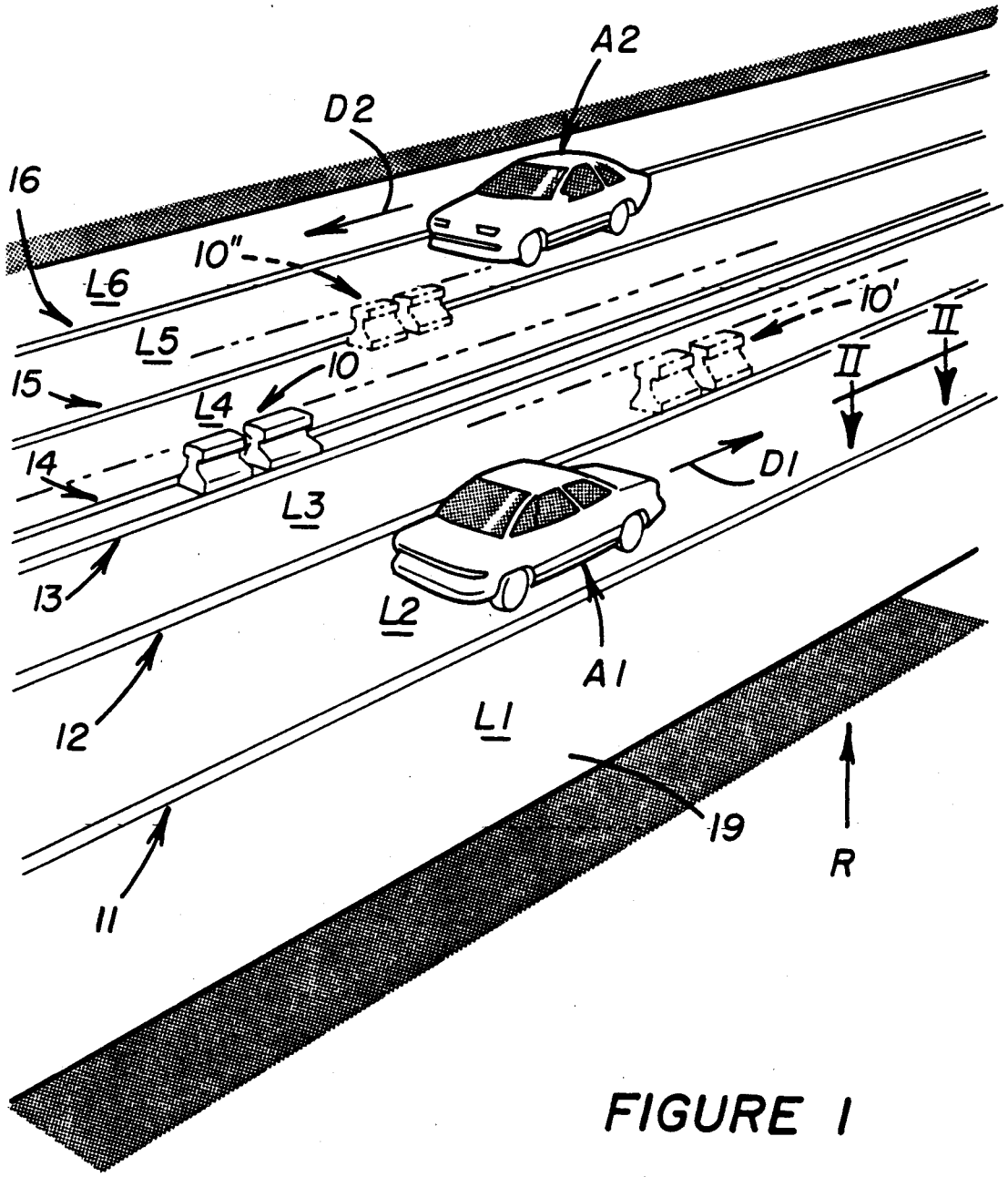
FIG. 1 partially illustrates a roadway defining a plurality of traffic lanes and a moveable lane barrier system mounted on the roadway.

FIG. 1 partially illustrates a roadway defining a plurality of parallel side-by-side traffic lanes L1–L6. In the illustrated example, a first automobile A1 is travelling in a first direction D1 in lane L2 and a second automobile A2 is travelling in a second direction D2 in lane L5. A lane barrier system 10 of the type described in the above-referenced patents is disposed in the middle of the roadway to separate it into three lanes L1–L3 for accommodating traffic moving in direction D1 and into three lanes L4–L6 to accommodate traffic moving in the opposite direction D2.

As further illustrated in FIG. 1, the lane barrier system is adapted to be moved to a second position 10′ whereby traffic flow in direction D1 would be confined to lanes L1 and L2 with traffic flow in direction D2 being enlarged to include traffic lanes L3–L6. Lane barrier system 10 is further adapted to be moved to position 10″ to reverse the number of accommodating lanes for traffic flowing in directions D1 and D2.

The traffic lanes are separated and defined by a plurality of parallel and uni-directional light reflective lane markers 11–16 to clearly delineate the lanes from each other. In one commercial application, the width of each lane L1–L6 can be ten feet and the distance between parallel lane markers 13 and 14 two feet, to accommodate the width of lane barrier system 10. Lane markers 11, 12 and 13 are only visible to a driver travelling in direction D1, whereas lane markers 14, 15 and 16 are only visible to a driver travelling in direction D2. Thus, when lane barrier system 10 is in its intermediate position shown in FIG. 1, lanes L1–L3 will be delineated by visible lane markers 11, 12 and 13 (and adjacent lane barrier system 10) for traffic travelling in direction D1 and lanes L4–L6 will be delineated by visible lane markers 14 (and adjacent lane barrier system 10), 15 and 16 for traffic travelling in direction D2. When the lane barrier system is moved to position 10′, lanes L1 and L2 will be delineated by visible lane markers 11 and 12 (and adjacent lane barrier system 10′) whereas lanes L3–L6 will be delineated sequentially by lane barrier system 10, and visible lane markers 14–16. The width of the median strip between lane markers 13 and 14 is thus additive to lane L3 to compensate for the "lost" width of lane barrier system 10′. When the lane barrier system is moved to position 10″, the reverse situation occurs with lane marker 13 (and not lane marker 14) being visible to traffic travelling in direction D1 to provide the desired ten foot wide lane between the lane barrier system and lane marker 13.

Figures 2, 3, 4:
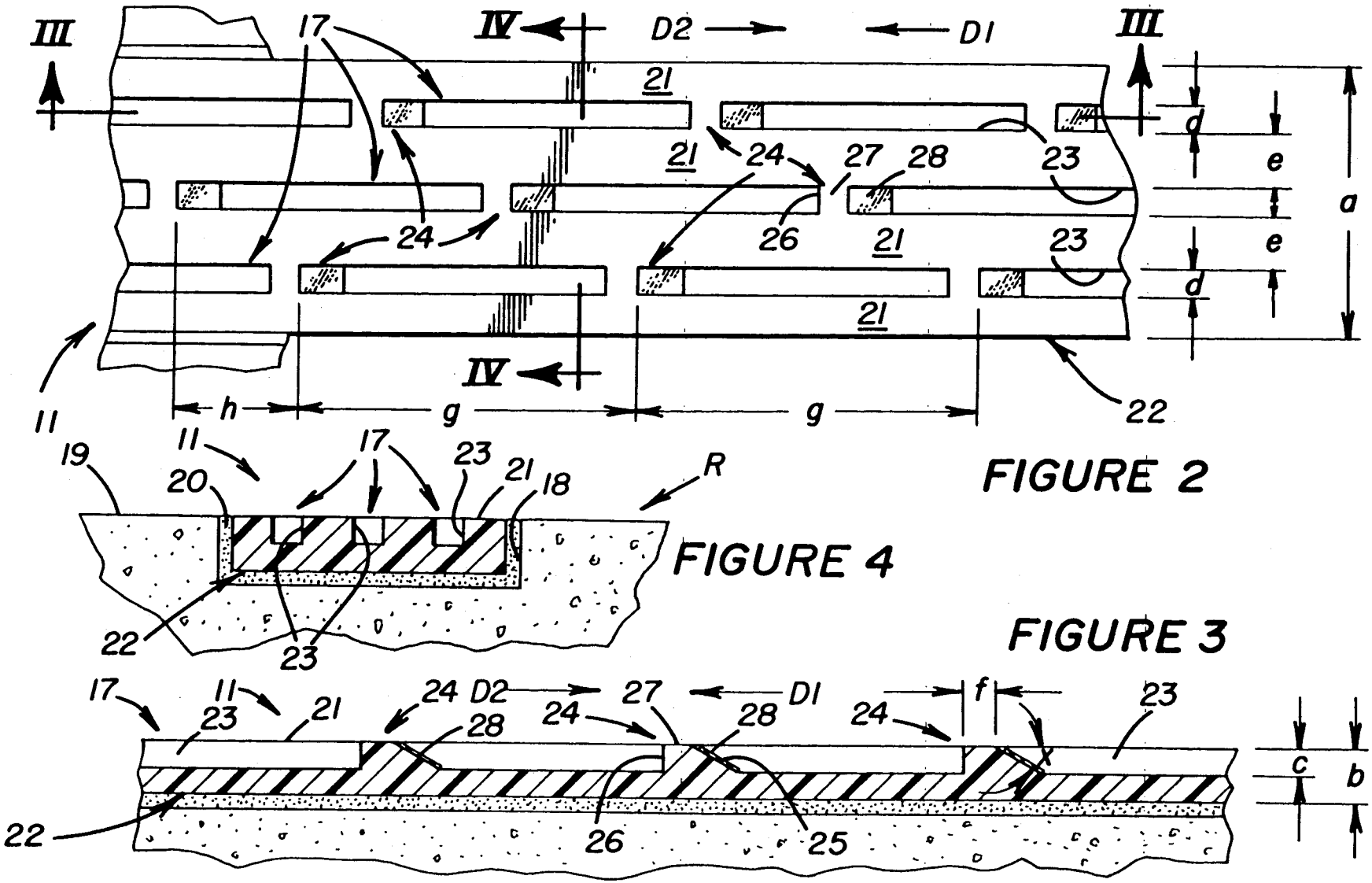
FIG. 2 is an enlarged partial top plan view, generally taken in the direction of arrows II—II in FIG. 1, illustrating a typical lane marker of this invention employed on the roadway.
FIG. 3 is a longitudinal sectional view through the lane marker, taken in the direction of arrows III—III in FIG. 2.
FIG. 4 is a cross-sectional view through the lane marker, taken in the direction of arrows IV—IV in FIG. 2.

Referring to the embodiment shown in FIGS. 2–4, each lane marker 11–16 comprises three elongated and parallel delineating strips 17. Lane marker 11, for example, is secured within a groove 18, defined in an upper surface 19 of roadway R. The lane marker is preferably composed of a high impact resistant plastic material secured within groove 18 by an adhesive 20, such as a standard epoxy based adhesive. Flat upper surface portions 21 of the lane marker are flush with the horizontally disposed upper surface 19 of the roadway.

The plastic material composing delineating strip 17 may constitute ABS (acrylonitrile butadiene and styrene) which is suitably composed to exhibit the desired chemical and physical characteristics, such as high chemical resistance, heat stability, impact resistance, toughness, rigidity and ease of processing. Suitable pigments can be added to the resin to match the color of the roadway proper, e g., black or grey. Each lane marker can be processed by conventional injection molding, extrusion or other standard techniques.

Still referring to FIGS. 2–4, lane marker 11, is preferably formed as an elongated plastic member having a main body 22. Each delineating strip 17 comprises a longitudinally extending slot 23, interrupted by a series of longitudinally spaced segments 24 bridged laterally across the slot. As shown in FIG. 3, each segment 24 comprises a leading surface 25 on a proximal side of the segment, a trailing surface 26 on a distal side of the segment and a flat intermediate surface 27 flush with upper surface portions 21 of the main body of the lane marker.

Since intermediate surfaces 27 of the segments are flush with upper surface portions 21 of main body 22 and with upper surface 19 of the roadway, substantial support will be provided for the tires of vehicles without inducing tire "rutting." Further and as shown in FIG. 2, the segments and surfaces 27 of each delineating strip 17 are preferably offset longitudinally relative to the segments of the next adjacent and parallel delineating strip to further aid in this tire supporting function.

Light reflective means are formed only on leading surface 25 of each segment 24 for visually displaying the delineating strip when it is subjected to light and viewed by a driver travelling towards the facing series of light reflective means. Each light reflective means comprises a light reflector 28, either adhesively secured to surface 25 in strip-form or molded directly on the surface when the lane marker is fabricated. For example, standard glass bead technology can be used to form the reflective surface on an adhesively backed strip suitably secured to surface 25. Alternatively, conventional cube corner retro-reflective technology can be used to adhere a film of reflective material directly onto the surface. The strip or film can be suitably composed to provide the desired reflective characteristics for nighttime visibility and/or for daytime visibility. i.e., high-intensity white.

The glass bead or glass-ceramic technology involves materials essentially formed in the same manner as conventional glass and then subjected to heat treatments which effect controlled nucleation and crystallization. The physical properties of the reflective material used for light reflectors 28 can be closely controlled by composition make up and manufacturing techniques to provide the desired wearability and resistance to impact loading and chemical erosion. The glass-ceramic material is normally coated with a high impact and clear plastic material with the major constituents of the glass-ceramic being based on glasses comprising magnesium oxide, lithium oxide, aluminum oxide and/or silicon dioxide. The crystalline phase or phases and their morphology essentially control the properties of the materials with the starting chemical composition and heat treatment primarily determining which crystalline phases will result. Reflective optics substrates of this type are well-known to those skilled in the art.

The reflective material can be suitably colored by adding one or more colorants to provide the desired color, such as red (cadmium sulfide, cadmium selenide or cuprous oxide) or yellow (cerium oxide with titanium oxide).

Leading surface 25 of segment 24 is preferably disposed at an angle X to also place light reflector 28 at an acute angle preferably approximating from 10° to 50°, relative to a horizontal plane containing upper surface portions 21 of the lane marker. In one embodiment of this invention, such angle constituted 30° to provide clear visibility to an oncoming driver whose eye level approximated a standard 42" above the roadway and to protect the reflector against tire impact. In such embodiment, wherein three parallel delineating strips 17 were employed on the lane marker as illustrated in FIGS. 2–4, lane marker was dimensioned as follows: a=5.0"; b=1.0"; c=0.5"; d=0.5"; e=1.0"; f=0.5"; g=6.0"; and h=1.75". Further, trailing surface 26 of each segment 24 was disposed perpendicular relative to the horizontal plane containing upper surface portions 21 of the lane marker.

From the above description, it will be appreciated by those skilled in the art that unidirectional light reflective lane markers 11–16 in FIG. 1 can be suitable positioned on roadway R to provide the desired visibility thereof in one direction of traffic, but not in the other. As shown in FIGS. 2 and 3, drivers travelling in direction D1 are able to visually detect the three delineating strips 17 comprising lane maker 11, for example, whereas drivers travelling in the opposite direction D2 would be unable to visualize the same at critical approach distances.

As described above, the flush mounting of surfaces 27 of segments 24 with upper surface 19 of the roadway and the longitudinal staggering of the segments in each delineating strip 17 will induce smooth engagement of vehicle tires thereover. Such flush mounting also enables the use of snow plows and the like on the roadway without giving rise to lane marker damages. Further, the unidirectional light reflecting lane marker of this invention finds particular application for use with lane barrier system 10 (FIG. 1) in the manner described above. The orientation, number of delineating strips 17 used for a particular lane maker and coloring of reflectors 28 can be varied to meet specific design requirements.

I claim:

1. A roadway defining at least one pair of side-by-side first and second traffic lanes for conveying traffic in first and second opposite directions, respectively, and a unidirectional light reflective lane marker secured on said roadway comprising at least one delineating strip separating said traffic lanes from each other, said delineating strip comprising light reflective means for visually displaying said delineating strip when it is subjected to light and viewed by a driver travelling in said first direction on said first traffic lane and for at least substantially rendering said delineating strip invisible when it is viewed by a driver travelling in said second direction on said second traffic lane, means defining an elongated groove in an upper surface of said roadway and wherein said lane marker, including said light reflective means, is secured and entirely confined within said groove, said delineating strip comprising an elongated, opaque and one-piece member defining a flat upper surface disposed in a horizontal plane flush with an upper surface of said roadway, and an elongated slot formed in the upper surface of said member and solely interrupted by a series of longitudinally spaced segments formed integrally within said member and bridged laterally across said slot, each said segment comprising a leading surface on a proximal side of said segment, a trailing surface on a distal side of said segment and a flat intermediate surface flush with the flat upper surface of said member and with the upper surface of said roadway, said light reflective means being disposed and confined solely on the leading surface of said segment and in fully protected relationship within said groove.

2. The roadway of claim 1 further comprising means for adhesively securing said lane marker within said groove.

3. The roadway of claim 1 wherein said lane marker comprises at least two of said delineating strips disposed in transversely spaced and parallel relationship relative to each other.

4. The roadway of claim 1 wherein the light reflective means of one said delineating strips are staggered longitudinally relative to the light reflective means of the other one of said delineating strips.

5. The roadway of claim 1 further comprising a movable lane barrier system comprising a plurality of interconnecting modules disposed on said roadway, closely adjacent to said lane marker, for separating said traffic lanes from each other.

6. The roadway of claim 5 wherein a plurality of said lane markers are secured in parallel relationship on said roadway and wherein said lane barrier system is adapted to be moved from a first position closely adjacent to a first one of said lane markers to a second position closely adjacent to a second one of said lane markers.

7. The roadway of claim 6 wherein the delineating strip of the first one of said lane markers is visible when it is viewed in said first direction and is rendered at least substantially invisible when it is viewed in said second direction and the delineating strip of the second one of said lane markers is rendered at least substantially invisible when it is viewed in said first direction and is visible when it is viewed in said second direction.

8. The roadway of claim 1 wherein said leading surface is disposed at an acute angle relative to said horizontal plane and said trailing surface is disposed at least approximately perpendicular relative to said horizontal plane.

9. The roadway of claim 1 wherein said lane marker comprises a plurality of delineating strips disposed in parallel relationship relative to each other and wherein the segments and light reflecting means of each delineating strip are staggered longitudinally relative to the segments and light reflective means of a next, laterally adjacent delineating strip.

10. A reflective lane marker adapted for securance on a roadway for separating laterally adjacent traffic lanes from each other comprising an elongated, opaque and one-place member defining a flat upper surface disposed in a horizontal plane and adapted to be positioned in flush relationship relative to an upper surface of said roadway, an elongated and opaque delineating strip formed in said lane marker and extending longitudinally in a first direction, said delineating strip comprising an elongated slot formed in the upper surface of said member and solely interrupted by a series of longitudinally spaced segments formed integrally within said member and bridged laterally across said slot, and light reflective means on each segment of said delineating strip and entirely confined within said slot for visually displaying said delineating stripe when it is viewed in said first direction.

11. The lane marker of claim 10 wherein each said segment comprises a leading surface on a proximal side of said segment, a trailing surface on a distal side of said segment and a flat intermediate surface flush with the flat upper surface of said member.

12. The lane member of claim 11 wherein said reflective means is disposed solely on the leading surface of said segment.

13. The lane member of claim 12 wherein said leading surface slopes upwardly in said first direction to intersect a leading edge of said intermediate surface and is disposed at an acute angle relative to said horizontal plane.

14. The lane marker of claim 13 wherein said trailing surface is disposed at least approximately perpendicular relative to said horizontal plane.

15. The lane marker of claim 13 wherein said acute angle is selected from the approximate range of from 10° to 50°.

16. The lane marker of claim 15 wherein said acute angle at least closely approximates 30°.

17. The lane marker of claim 17 wherein said light reflective means comprises glass beads or a cube-corner retro-reflective material.

18. The lane marker of claim 12 wherein said lane marker comprises a plurality of delineating strips formed in said member and disposed in parallel relationship relative to each other and wherein the segments of each delineating strip are staggered longitudinally relative to the segments of a next, laterally adjacent delineating strip to further position the flat intermediate surfaces of said delineating strips in longitudinally staggered relationship relative to each other.

19. A reflective lane marker in the form of an elongated, opaque and one-piece member defining a flat upper surface disposed in a longitudinal plane and adapted for securance on a roadway for separating laterally adjacent traffic lanes from each other comprising an elongated delineating strip entirely formed integrally in said member and extending longitudinally in a first direction, said strip comprising an elongated slot formed in the upper surface of said member and solely interrupted by a series of longitudinally spaced segments formed integrally with said member and bridged laterally across and entirely disposed within said slot, and light reflective means on an outer surface of each of said segments and confined within said slot to reflect light for visually displaying said delineating strip, each said segment comprising a leading surface on a proximal side of said segment, a trailing surface on a distal side of said segment and a flat intermediate surface flush with the flat upper surface of said member.

* * * * *

UNITED STATES PATENT AND TRADEMARK OFFICE

CERTIFICATE OF CORRECTION

PATENT NO. : 5,006,010

DATED : April 9, 1991

INVENTOR(S) : John W. Duckett

It is certified that error appears in the above-identified patent and that said Letters Patent is hereby corrected as shown below:

Claim 10, column 5, line 67, after delete "place" and insert -- piece --.

Claim 10, column 6, line 13, delete "stripe" and insert --strip --.

Claim 17, column 6, line 35, delete "17" and insert -- 10 --.

Signed and Sealed this

Fourth Day of August, 1992

*Attest:*

*Attesting Officer*

DOUGLAS B. COMER

*Acting Commissioner of Patents and Trademarks*